US007485012B2

(12) United States Patent
Daugherty et al.

(10) Patent No.: US 7,485,012 B2
(45) Date of Patent: Feb. 3, 2009

(54) ELECTRICAL CONNECTION SYSTEM HAVING WAFER CONNECTORS

(75) Inventors: James D. Daugherty, Brookfield, OH (US); Christopher A. Margrave, Warren, OH (US); Thomas E. McLain, Warren, OH (US); John T. Kightlinger, Canfield, OH (US); Theodore R. Schmidt, Kinsman, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/823,687

(22) Filed: Jun. 28, 2007

(65) Prior Publication Data

US 2009/0004922 A1 Jan. 1, 2009

(51) Int. Cl.
*H01R 13/502* (2006.01)

(52) U.S. Cl. ..... 439/701; 439/540.1; 439/680

(58) Field of Classification Search ..... 439/540.1, 439/541.5, 701, 680, 350, 686
See application file for complete search history.

(56) References Cited

U.S. PATENT DOCUMENTS

| | | | | |
|---|---|---|---|---|
| 3,692,966 | A * | 9/1972 | Lancaster | 200/51.1 |
| 3,993,394 | A | 11/1976 | Cooper | |
| 4,596,436 | A * | 6/1986 | Kraemer et al. | 439/701 |
| 4,619,490 | A | 10/1986 | Hawkings | |
| 4,674,814 | A * | 6/1987 | Hoshino et al. | 439/586 |
| 4,913,667 | A * | 4/1990 | Muz | 439/733.1 |
| 5,525,066 | A * | 6/1996 | Morlion et al. | 439/108 |
| 5,725,397 | A * | 3/1998 | Fukamachi et al. | 439/701 |
| 6,203,376 | B1 | 3/2001 | Magajne et al. | |
| 6,231,398 | B1 * | 5/2001 | Furutani et al. | 439/701 |
| 6,273,762 | B1 | 8/2001 | Regnier | |
| 6,361,374 | B1 | 3/2002 | Lloyd et al. | |
| 6,619,997 | B1 | 9/2003 | Wilson et al. | |
| 6,645,003 | B2 | 11/2003 | Yoshida et al. | |
| 6,676,433 | B1 * | 1/2004 | Ozaki | 439/353 |

(Continued)

FOREIGN PATENT DOCUMENTS

| | | |
|---|---|---|
| EP | 0 153 632 | 9/1985 |

(Continued)

OTHER PUBLICATIONS

International Search Report dated Oct. 6, 2008.

*Primary Examiner*—Tho D Ta
(74) *Attorney, Agent, or Firm*—David P. Wood

(57) ABSTRACT

An electrical connection system comprises a connector shell and a plurality of wafer connectors that plug into the connector shell. Each wafer connector holds a plurality of electric terminals that are attached to ends of electric cables, and a lock bar that is attached to the connector shell to retain the wafer connectors in the connector shell. The connector shell has an upper wall, a lower wall and side walls that are spaced apart to define a stack of wafer connector compartments that extends from the upper wall to the lower wall, an uppermost compartment being defined in part by the upper wall and an lowermost compartment being defined in part by the lower wall. The side walls each have slots in their confronting surfaces for each compartment in the stack of wafer connector compartments for locating a wafer connector in each compartment, the slots being longitudinal and open ended so that a wafer connector can be inserted longitudinally into each compartment from an insertion end of the shell.

12 Claims, 4 Drawing Sheets

U.S. PATENT DOCUMENTS

| | | | | |
|---|---|---|---|---|
| 6,837,751 | B2 | 1/2005 | Vanden-Wymelenberg et al. | |
| 6,997,755 | B2 | 2/2006 | Varis | |
| 7,134,190 | B2 | 11/2006 | Bungo et al. | |
| 2005/0112940 | A1* | 5/2005 | Naganishi | 439/540.1 |

FOREIGN PATENT DOCUMENTS

| | | |
|---|---|---|
| FR | 2 371 072 | 6/1978 |
| GB | 1 352 970 | 5/1974 |
| WO | 92/22943 | 12/1992 |

* cited by examiner

ELECTRICAL CONNECTION SYSTEM HAVING WAFER CONNECTORS

BACKGROUND OF THE INVENTION

This invention relates to an electrical connection system and more particularly to an electrical connection system that has wafer connectors.

U.S. Pat. No. 3,993,394 issued to James Brand Cooper Nov. 23, 1976 discloses an electrical connection system wherein each connector half comprises two wafer connectors in a connector shell.

U.S. Pat. No. 6,645,003 issued to Haruki Yoshida Nov. 11, 2003 discloses an electrical connection system comprising an electrical joint connector 100 comprising stackable housings 10*a* and 10*b*. Joint connector 100 mates with electrical connector 200.

U.S. Pat. No. 6,837,751 issued to Mark J. Vanden Wymelenberg et al. Jan. 4, 2005 discloses stackable wafer connectors 106*a* and 106*b* that are side loaded into housing 102 (FIG. 22).

U.S. Pat. No. 7,134,190 issued to Edward M. Bungo et al. Nov. 14, 2006 discloses a wire harness manufacturing machine that uses wafer connectors such as the stackable wafer connectors 88 that are side loaded into housing 44 (FIG. 3).

SUMMARY OF THE INVENTION

In one aspect, the invention provides an electrical connection system comprising a connector shell and a plurality of wafer connectors that plug into the connector shell, each wafer connector holding a plurality of electric terminals that are attached to ends of electric cables, and a lock bar that is attached to the connector shell to retain the wafer connectors in the connector shell.

In another aspect, the invention provides an electrical connection system comprising a connector shell and a plurality of wafer connectors that plug into the connector shell, each wafer connector holding a plurality of electric terminals that are attached to ends of electric cables, the connector shell having an upper wall, a lower wall and side walls that are spaced apart to define a stack of wafer connector compartments that extends from the upper wall to the lower wall, an uppermost compartment being defined in part by the upper wall and an lowermost compartment being defined in part by the lower wall, and the side walls each having slots in their confronting surfaces for each compartment in the stack of wafer connector compartments for locating a wafer connector in each compartment, the slots being longitudinal and open ended so that a wafer connector can be inserted longitudinally into each compartment from an insertion end of the shell.

DETAILED DESCRIPTION OF THE PREFERRED EMBODIMENTS

Figure 1:
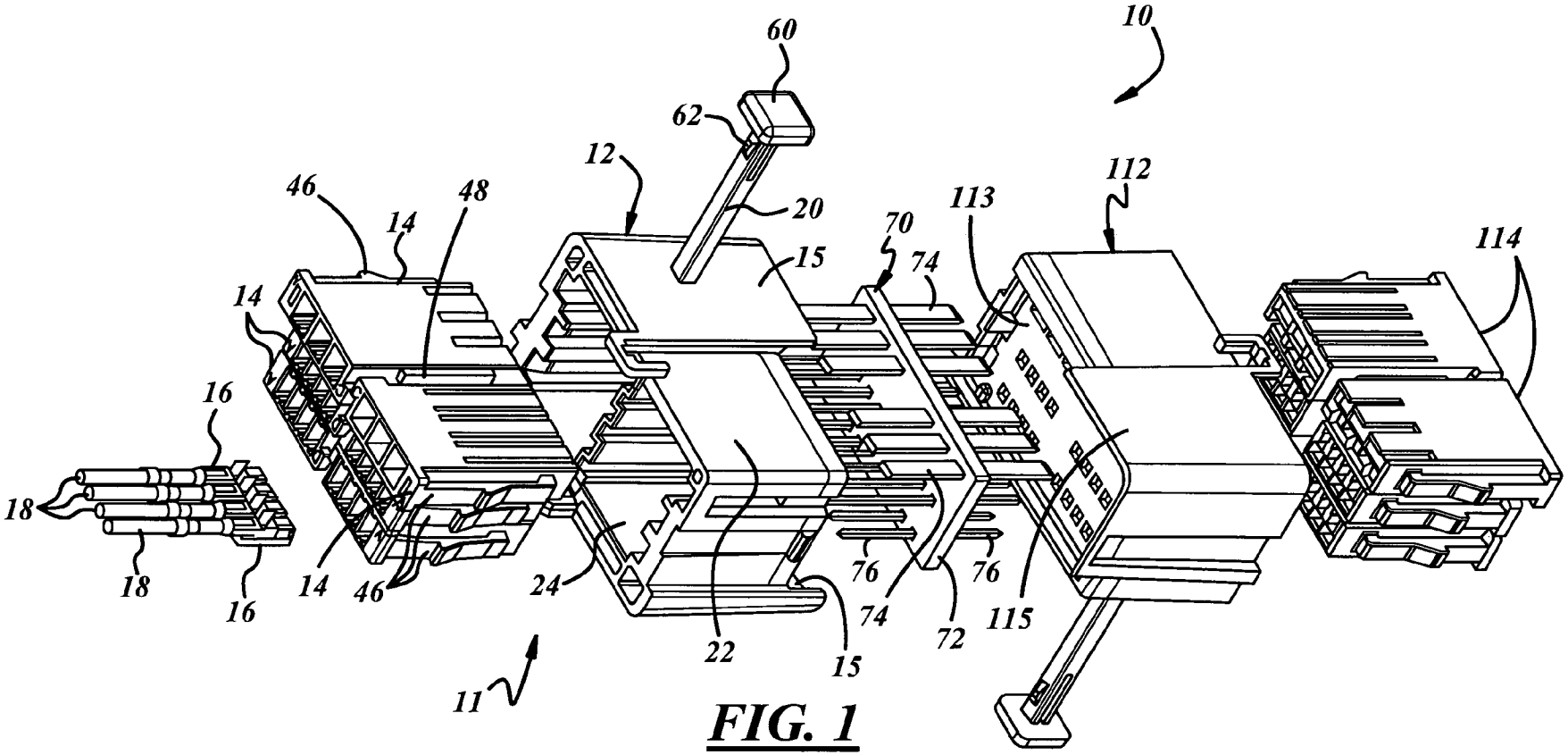
FIG. 1 is an exploded perspective view of an electrical connection system in accordance with the invention.
Figure 2:
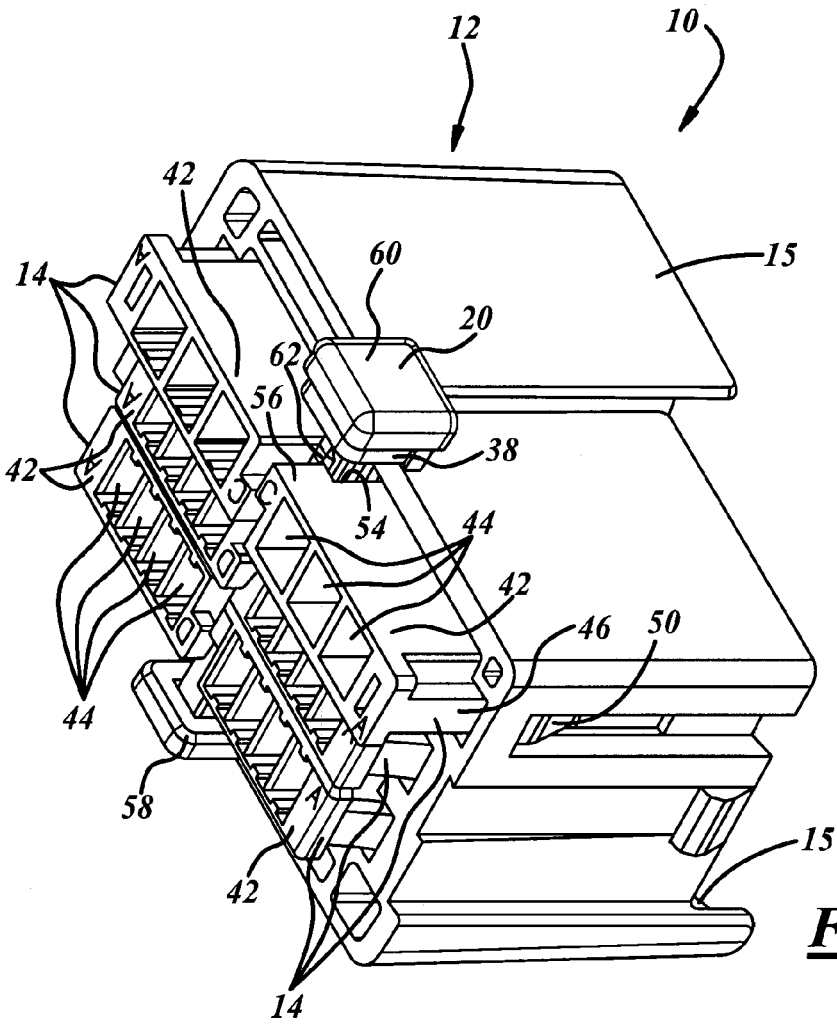
FIG. 2 is a perspective view of a sub-assembly of the electrical connection system shown in FIG. 1.

Referring now to FIG. 1 of the drawings, an electrical connection system 10 includes an electrical connector 11 that comprises a connector shell 12 and a plurality of wafer connectors 14 that plug into the connector shell 12. Each wafer connector 14 holds a plurality of electric terminals 16 that are attached to the ends of electric cables 18. The electrical connection system 10 may include a lock bar 20 that is attached to the connector shell 12 to retain the wafer connectors 14 in the connector shell 12 as best shown in FIG. 2. FIG. 1 shows only a representative sample of electric terminals 16 and electric cables 18 while FIG. 2 does not show any for clarity.

Figure 3:
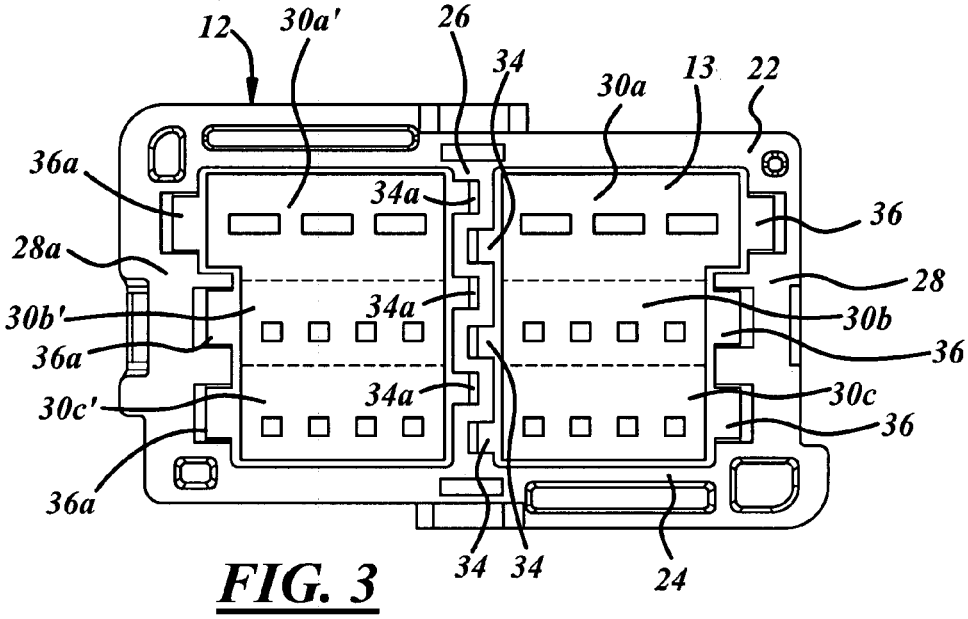
FIG. 3 is a rear view of a component of the sub-assembly of the electrical connection system shown in FIG. 2.

Referring now to FIG. 3, the connector shell 12 comprises an upper wall 22, a lower wall 24 and side walls 26, 28 that are spaced apart to define a stack of wafer compartments 30*a*, 30*b*, 30*c* that extends from the upper wall 22 to the lower wall 24. The uppermost compartment 30*a* is defined in part by the upper wall 22 and the lowermost compartment 30*c* is defined in part by the lower wall 28. The connector shell 12 preferably includes a face plate 13 at a forward end to close the forward end of the compartments and to serve as a terminal guide. The connector shell 12 preferably does not have any partition walls between the compartments 30*a*, 30*b*, 30*c* in the stack to save space. But in the event of a large stack of compartment 30, a partition wall or walls, may be provided to stabilize the connector shell 12 as explained below in connection with FIG. 7.

The side walls 26, 28 each have at least one slot 34 or 36 in their confronting surfaces for each wafer compartment 30*a*, 30*b*, 30*c* to locate a wafer connector 14 in each wafer compartment as explained below. Moreover, each slot 34 or 36 is longitudinal and open ended so that a wafer connector 14 can be inserted longitudinally into each wafer compartment from an insertion or rear end of the connector shell 12 that is shown in FIG. 3.

Figure 4:
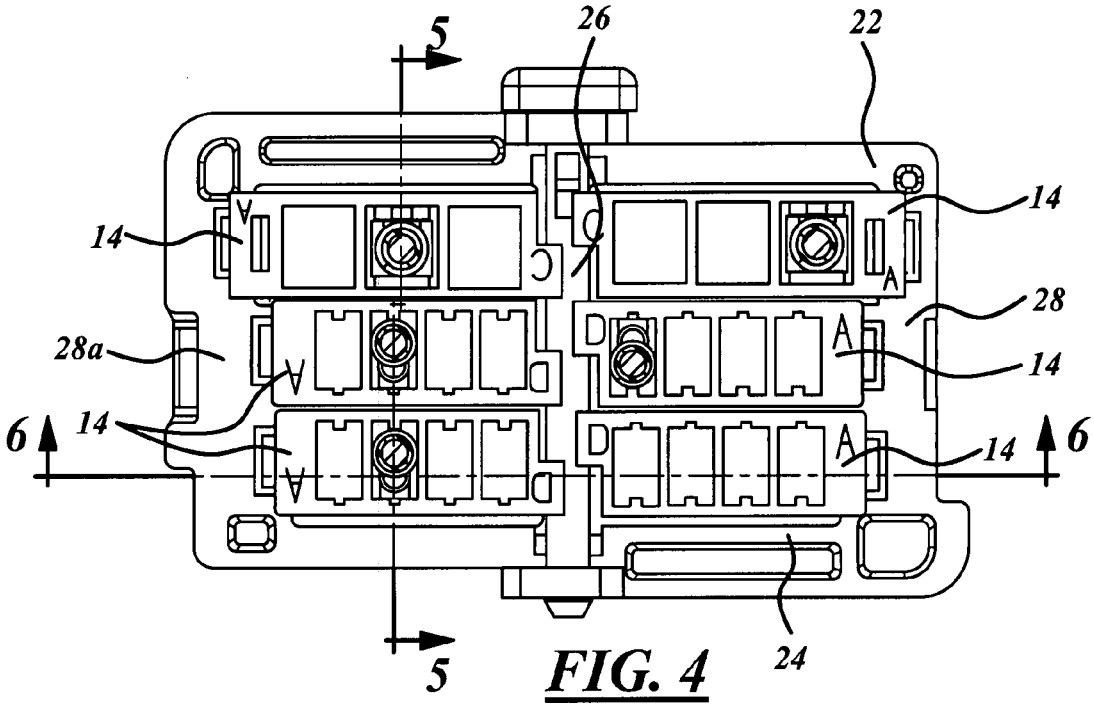
FIG. 4 is a rear view of the sub-assembly of the electrical connection system shown in FIG. 2.

The connector shell 12 may define more than one stack of wafer compartments. For instance the connector shell 12 has two stacks of wafer compartments that are separated by a common side wall that that is between two outer side walls. In this instance, side wall 26 is a common side wall between outer side wall 28 and 28*a* with a first stack of wafer compartments 30*a*, 30*b* and 30*c* between common side wall 26 and outer side wall 28; and a second stack of wafer compartments 30*a*', 30*b*' and 30*c*' between the common side wall 26 and the outer side wall 28*a*. This second stack of wafer compartments 30*a*', 30*b*' and 30*c*' is like the first stack of wafer compartments 30*a*, 30*b* and 30*c* with the side wall 26 being a common side wall having slots in both side surfaces for the respective stacks of wafer compartments. In this regard, it should be noted that the configuration of the slots 34*a*, 36*a* in the opposite side walls 26, 28*a* for the second stack of wafer compartments 30*a*', 30*b*' and 30*c*' are upside down versions of the slot configurations of the slots 34, 36 in the opposite side walls 26, 28 for the first stack of wafer compartments 30*a*, 30*b* and 30*c*. Thus the wafer connectors 14 are inserted right side up in the right hand stack of wafer compartments 30*a*, 30*b* and 30*c* while the wafer connectors 14 are inserted upside down in the left hand stack as best shown in FIG. 4. This right side up/upside down juxtaposed arrangement permits two sets of slots 34 and 34*a* that are inter-digitated in a relatively thin common side wall 26.

The wafer connectors 14 typically comprise a thin, generally hexahedral connector body 42 having a plurality of terminal cavities 44 extending through the connector body in a longitudinal direction. The connector body 42 preferably has a small number of terminal cavities 44, for instance three or four, in a single row to maximize the use of the terminal cavities 44 in each wafer connector 14 while minimizing the height of the connector body 42 and the need for empty terminal cavities 44 for a given application. As best shown in FIGS. 2 and 4 the uppermost connector body 42 has three terminal cavities 44 while the smaller lowermost connector body 42 has four smaller terminal cavities 44.

Figure 6:
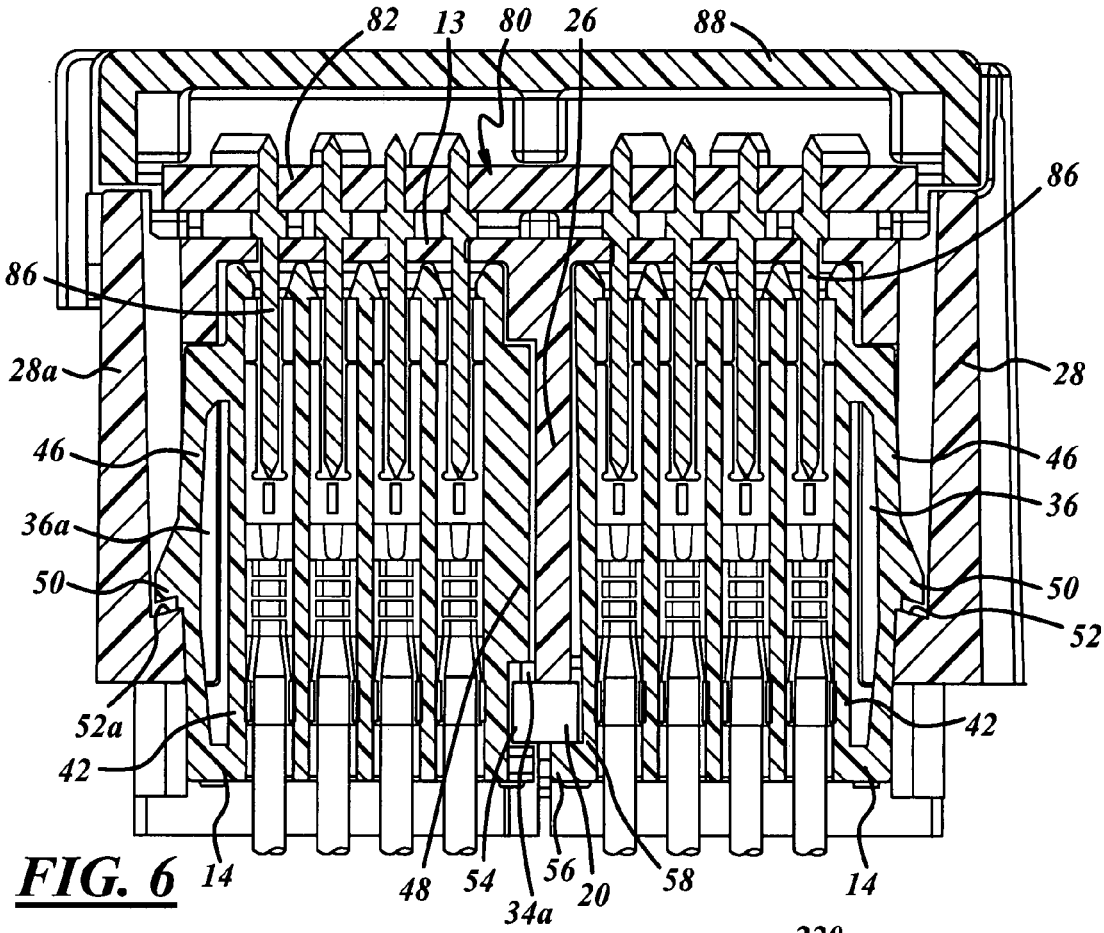
FIG. 6 is a transverse section taken substantially along the line 6-6 of FIG. 4 looking in the direction of the arrows.

Each connector body 42 has side ribs 46, 48 that are different on each side so as to match the different slots 34, 36, 34*a*, 36*a* in the opposite side walls of the respective wafer compartments. On side rib 46 may be a depressible beam that carries a lock nib 50 that cooperates with a lock shoulder 52 or 52*a* of the connector body 42. Lock shoulders 52, 52*a* communicate with slot 36 or 36*a* in outer side wall 28 or 28*a* of the respective wafer compartment such as wafer compartment 30*c* or 30*c*' as best shown in FIG. 6, to latch the wafer connector 14 in the wafer compartment. The lock shoulder 52 or 52*a* is preferably part of an outer side wall 28 or 28*a* and the depressible side rib 46 with the lock nib 50 may cooperate with each shoulder 52 in a slot that extends through an outer side wall.

The opposite side rib 48 of each connector body 42 preferably stops short of the outer rear end of the connector body 42 to provide a lock groove 54 between the end of the side rib 48 and an optional lateral protrusion 56 at the outer rear end of the connector body 42. The function of this optional lock groove 54 is explained below.

Figure 5:
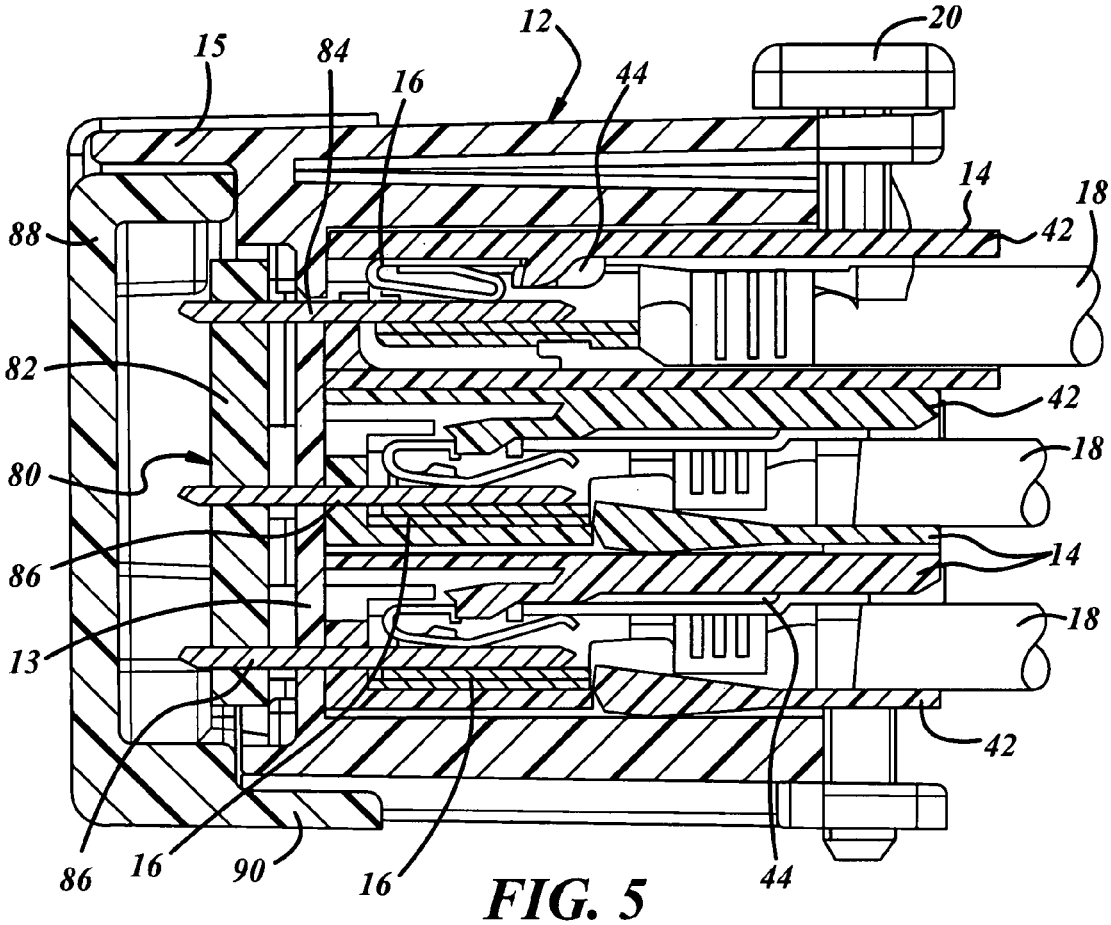
FIG. 5 is a longitudinal section taken substantially along the line 5-5 of FIG. 4 looking in the direction of the arrows.

The shapes of the terminal cavities 44 and the electric terminals 16 are not critical. Any shapes may be used so long as each electric terminal 16 is insertable into a terminal cavity 44 through an opening at the rear end of the connector body 42 and means are provided to retain the electric terminal 16 in the terminal cavity 44 for connection to a mating electric terminal. FIG. 5 shows typical known arrangements for retaining electric terminals in terminal cavities. Each electric terminal 16 is attached to an electric cable 18 in a conventional manner.

As indicated above, the electrical connection system 10 may include a lock bar 20 that is attached to the connector shell 12 to retain the wafer connectors 14 in the connector shell 12 as best shown in FIG. 2. This lock bar 20 passes through aligned loops 58 that project from the rear ends of the upper and lower walls 22, 24 which align the lock bar 20 with the rear end of the common side wall 26. During assembly, the lock bar 20 passes through the lock grooves 54 of the wafer connectors 14 which are aligned with the common side wall 26 between the two stacks of wafer compartments 30*a*, 30*b*, 30*c* and 30*a*', 30*b*' and 30*c*'. The lock bar 20 has a head 60 and a resilient lock nib 62 near the head. The lock bar 20 is locked in place by the head 60 at an outer end of the lock bar 20 that engages an outer side of one of the loops 58 and the lock nib 62 that engages an opposite inner side of the one loop.

The electrical connector 11 is assembled in the following manner. Each of the wafer connectors 14 is loaded with a predetermined number of electric terminals 16 attached to electrical cables 18. The loaded wafer connectors 14 are then inserted into the wafer compartments 30*a*, 30*b*, 30*c*, 30*a*', 30*b*' and 30*c*' with the side ribs 46, 48 engaging in the slots 34, 36, 34*a* and 36*a* and pushed forward until the forward ends of the side ribs 46, 48 engage forward ends of the slots and/or the wafer connectors 14 engage face plate 13. The wafer connectors 14 are now individually retained in the wafer compartments 30*a*, 30*b*, 30*c*, 30*a*', 30*b*' and 30*c*' with their rear ends protruding out of the connector shell 12 by the lock nibs 50 engaging lock shoulders 52 or 52*a*. The lock bar 20 is then attached to the connector shell 12 to retain all of the wafer connectors 14 in the wafer compartments positively.

Any of the wafer connectors 14 can be detached from the electrical connector 11 independently of the other wafer connectors, for repair, replacement or any other reason. If the electrical connector 11 includes a lock bar 20, the lock bar 20 is removed so that each wafer connector 14 is retained in the electrical connector 11 individually and independently of the other wafer connectors. Any of the wafer connectors 14 can then be detached from the electrical connector 11 simply by depressing the side rib 46 and pulling the protruding end of the associated connector body 42 out of the appropriate wafer compartment 30*a*, 30*b*, 30*c*, 30*a*', 30*b*' and 30*c*' with sufficient force to disengage its lock nib 50 from lock shoulder 52 or 52*a*. The lock nib 50 being on a side rib 46 that is preferably in the form of a depressible beam reduces the force required to disengage the lock nib 50 from lock shoulder 52 or 52*a*.

The electrical connector 11 may be used in conjunction with another identical electrical connector 111 in the electrical connection system that is shown in FIG. 1. The identical shells 12 and 112 of the respective electrical connectors 11 and 111 may include diagonally spaced L-shaped hoods 15 and 115 respectively that cooperate to form a chamber between face plates 13 and 113 when electrical connectors 11 and 111 are attached to each other. This chamber holds a circuit board assembly 70 comprising a circuit board 72 that supports male terminal blades 74 and male terminal pins 76 that extend in opposite directions from the circuit board 72. The terminal blades 74 and terminal pins 76 may be connected to each other in any predetermined manner either by internal traces or surface traces so as to establish electrical communication amongst and between the terminals 16 of electrical connector 11 and the identical terminals of electrical connector 111 (not shown). The circuit board assembly 70 thus serves a bussing function. In this regard it should be noted that the face plates 13 and 113 serve as terminal guides to guide the terminal blades 74 and terminal pins 76 into mating engagement with the terminals in the terminal cavities of the electrical connectors 11 and 111.

The electrical connector 11 may also be simply be used in connection with a circuit board assembly 80 in an electrical connection system that is shown in FIGS. 5 and 6. Here circuit board assembly 80 comprises a circuit board 82 that supports male terminal blades 84 and male terminal pins 86 that extend substantially in only one direction from the circuit board 82 as shown in FIGS. 5 and 6. In this instance, the terminal blades 84 and terminal pins 86 may be connected to each other in any predetermined manner either by internal traces or surface traces so as to establish electrical communication amongst and between the terminals 16 of electrical connector 11. Circuit board assembly 80 is disposed in a chamber that is formed by a cap 88 that is attached to shell 12 and that has diagonally spaced L-shaped hoods 90 that cooperate with the diagonally spaced L-shaped hoods of shell 12 to form the chamber.

The electrical connector 11 may also be used in other applications, such as with a mating electrical connector having male terminal blades and/or male terminal pins that mate with the terminals carried by electrical connector 11 or with a circuit board assembly having terminal blades and/or terminal pins that mate with the terminals carried by electrical connector 11.

Figure 7:
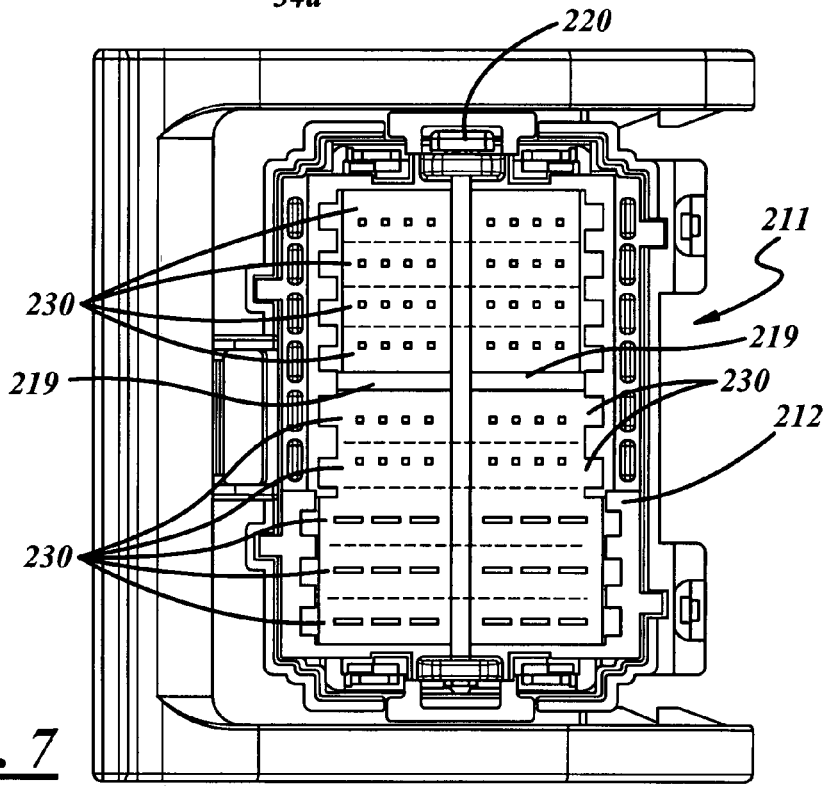
FIG. 7 is a rear view of a component of a second embodiment of an electrical connection system in accordance with the invention.

FIG. 7 shows another arrangement wherein the electrical connector 211 has a connector shell 212 that has eighteen (18)

wafer compartments 230 that are arranged in two stacks of nine (9) wafer compartments 30 each. Whereas the connector shell 12 does not have any partition walls between the wafer compartments 30*a*, 30*b*, 30*c*, or the wafer compartments 30*a*', 30*b*' 30*c*' in the respective stacks to save space, the connector shell 212 has one partition wall 219 in each stack to stabilize the connector shell 212 as shown in FIG. 7. The partition walls 219 for the respective stacks are preferably aligned as shown in FIG. 7. FIG. 7 shows the lock bar 220 for retaining the wafer connectors in the wafer compartments 30 in a positive manner. However, the wafer connectors which are identical to the wafer connectors 14 are not shown in the interest of clarity.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connection system comprising:

a connector shell and a plurality of wafer connectors holding a plurality of electric terminals that are attached to ends of electric cables, the connector shell having an upper wall, a lower wall and side walls that are spaced apart to define a stack of wafer compartments that extends from the upper wall to the lower wall, an uppermost compartment being defined in part by the upper wall and an lowermost compartment being defined in part by the lower wall, and the side walls each have slots in their confronting surfaces for each wafer compartment in the stack of wafer compartments for locating a wafer connector in each compartment, the slots being longitudinal and open ended so that a wafer connector can be inserted longitudinally into each wafer compartment from an insertion end of the shell, each wafer connector being insertable longitudinally into and withdrawable longitudinally from a wafer compartment individually through an opening at an insertion end of the connector shell, wherein the slots in the respective side walls for each compartment are different and wherein each wafer connector has a connector body that has side ribs that are different on each side of the connector of the body that match the different slots in the respective side walls of each wafer compartment, wherein one side rib of the connector body is a depressible beam that carries a lock nib that cooperates with a lock shoulder to latch the wafer connector in one of the wafer compartments, wherein the lock shoulder is in an outer side wall of the connector shell and the one side rib that is the depressible beam that carries the lock nib cooperates with the slot that is in the outer side wall, and wherein another side of the connector body cooperates with a lateral protrusion at the end of the connector body to provide a lock groove and wherein a lock bar that is attached to the connector shell passes through the lock groove to lock the connector body to the connector shell.

2. The electrical connection system as defined in claim 1 further including a lock bar that is attached to the connector shell to retain several of the wafer connectors in the connector shell, the lock bar passing through the lock groove in respective ones of the several of the wafer connectors to retain the wafer connectors in the wafer compartments.

3. The electrical connection system as defined in claim 2 wherein the lock bar passes through loops that project from the rear ends of the upper and lower walls which align with the rear end of the partition wall, the lock bar having a head and a resilient lock nib near the head that engage opposite sides of one of the loops to retain the lock bar.

4. An electrical connection system comprising:

a connector shell and a plurality of wafer connectors holding a plurality of electric terminals that are attached to ends of electric cables, the connector shell having an upper wall, a lower wall and side walls that are spaced apart to define a stack of wafer compartments that extends from the upper wall to the lower wall, an uppermost compartment being defined in part by the upper wall and an lowermost compartment being defined in part by the lower wall, and the side walls each have slots in their confronting surfaces for each wafer compartment in the stack of wafer compartments for locating a wafer connector in each compartment, the slots being longitudinal and open ended so that a wafer connector can be inserted longitudinally into each wafer compartment from an insertion end of the shell, each wafer connector being insertable longitudinally into and withdrawable longitudinally from a wafer compartment individually through an opening at an insertion end of the connector shell, wherein the connector shell has a second stack of wafer compartments that is separated from the stack of wafer compartments by a common side wall that that is between outer side walls and wherein the common side wall has slots in both surfaces for the respective stacks of wafer compartments, wherein the slots in the respective side walls for each wafer connector compartment are different for insuring receipt of the water connectors in the respective compartments in the correct orientation, wherein each wafer connector has a connector body that has side ribs that are different on each side of the connector body that match the slots in the respective side walls of each wafer compartment.

5. The electrical connection system as defined in claim 4 and wherein the slots in the respective side walls for the second stack of wafer compartments are upside down with respect to the slots in the respective side walls for the first stack of wafer compartments.

6. The electrical connection system as defined in claim 4 further including a lock bar that is attached to the connector shell to retain the wafer connectors in the connector shell, the lock bar passing through the lock grooves of the wafer connectors to retain the wafer connectors in the wafer compartments.

7. The electrical connection system as defined in claim 6 wherein the lock bar passes through loops that project from the rear ends of the upper and lower walls which align with the rear end of the partition wall, the lock bar having a head and a resilient lock nib near the head that engage opposite sides of one of the loops to retain the lock bar.

8. An electrical connection system comprising a connector shell and a plurality of wafer connectors that plug into the connector shell, each wafer connector having a connector body holding a plurality of electric terminals that are attached to ends of electric cables and a lock bar that is attached to the connector shell to retain the wafer connectors in the connector shell said lock bar passing through a lock groove formed by a side rib and a non-aligned lateral protrusion of the connector body of each wafer connector wherein the non-aligned lateral protrusion of the connector body of each wafer connector is outside the connector shell and the lock bar passes through loops that project from the connector shell.

9. An electrical connection system comprising:

a connector shell and a plurality of wafer connectors holding a plurality of electric terminals that are attached to ends of electric cables, the connector shell having an upper wall, a lower wall and side walls that are spaced apart to define a stack of wafer compartments that extends from the upper wall to the lower wall, an uppermost compartment being defined in part by the upper wall and an lowermost compartment being defined in part by the lower wall, and the side walls each have slots in their confronting surfaces for each wafer compartment in the stack of wafer compartments for locating a wafer connector in each compartment, the slots being longitudinal and open ended so that a wafer connector can be inserted longitudinally into each wafer compartment from an insertion end of the shell, each wafer connector being insertable longitudinally into and withdrawable longitudinally from a wafer compartment individually through an opening at an insertion end of the connector shell, wherein each wafer connector has a connector body that has side ribs that match the slots in the respective side walls of each wafer compartment, wherein one side rib of the connector body carries a lock nib that cooperates with a lock shoulder to latch the wafer connector in one of the wafer compartments, wherein another side rib of the connector body cooperates with a lateral protrusion at the end of the connector body to provide a lock groove, and wherein a lock bar that is attached to the connector shell passes through the lock groove to lock the connector body to the connector shell.

10. The electrical connection system as defined in claim 9 wherein the shell includes a face plate.

11. The electrical connection system as defined in claim 10 wherein the one side rib of the connector body is a depressible beam that carries the lock nib that cooperates with the lock shoulder to latch the wafer connector in the one of the wafer compartments.

12. The electrical connection system as defined in claim 11 wherein the lock shoulder is formed by a slot in an outer side wall of the connector shell.

* * * * *